US006837170B2

(12) United States Patent
Taft

(10) Patent No.: US 6,837,170 B2
(45) Date of Patent: Jan. 4, 2005

(54) MODULAR PALLET

(76) Inventor: Anthony Taft, 9603 S. Castle Rd., Sheridan, MI (US) 48884

( * ) Notice: Subject to any disclaimer, the term of this patent is extended or adjusted under 35 U.S.C. 154(b) by 72 days.

(21) Appl. No.: 10/183,918

(22) Filed: Jun. 27, 2002

(65) Prior Publication Data

US 2004/0000259 A1 Jan. 1, 2004

(51) Int. Cl.[7] ..... B65D 19/38
(52) U.S. Cl. ..... 108/57.25; 108/902
(58) Field of Search ..... 108/57.25, 57.26, 108/57.11, 56.1, 56.3, 901, 902

(56) References Cited

U.S. PATENT DOCUMENTS

| | | | | |
|---|---|---|---|---|
| 3,878,796 A | | 4/1975 | Morrison | |
| 5,101,737 A | | 4/1992 | Gomez | |
| 5,365,859 A | * | 11/1994 | Schrage | 108/56.1 |
| 5,417,167 A | * | 5/1995 | Sadr | 108/57.19 |
| 5,440,998 A | | 8/1995 | Morgan, IV et al. | |
| 5,456,189 A | * | 10/1995 | Belle Isle | 108/57.17 |
| 5,458,069 A | | 10/1995 | Stolzman | |
| 5,579,701 A | * | 12/1996 | Fook Wah | 108/56.1 |
| 5,941,179 A | | 8/1999 | Herring | |
| 6,006,677 A | * | 12/1999 | Apps et al. | 108/57.25 |
| 6,216,608 B1 | * | 4/2001 | Woods et al. | 108/57.25 |
| 6,305,301 B1 | * | 10/2001 | Piper et al. | 108/57.25 |
| 6,352,039 B1 | * | 3/2002 | Woods et al. | 108/57.25 |
| 6,354,230 B1 | * | 3/2002 | Maschio | 108/57.25 |

FOREIGN PATENT DOCUMENTS

GB 2194213 * 3/1988

* cited by examiner

*Primary Examiner*—Jose V. Chen
(74) *Attorney, Agent, or Firm*—Price, Heneveld, Cooper, DeWitt & Litton, LLP

(57) ABSTRACT

A modular pallet includes a plurality of spaced substantially parallel elongated stringer members, a plurality of spaced substantially parallel elongated upper deck members and a plurality of spaced substantially parallel elongated lower deck members. At least a portion of each of the upper/lower deck members, between first and second upper/lower deck member mating sections, is shaped to be perpendicularly received by upper/lower grooves in the elongated stringer members and interlocked at the first and second upper/lower deck member mating sections to different ones of the elongated stringer members by movement of at least one of the stringer member and the upper/lower deck member with respect to each other.

34 Claims, 5 Drawing Sheets

MODULAR PALLET

BACKGROUND OF THE INVENTION

The present invention is generally directed to a pallet and, more specifically, a modular pallet.

Pallets have been widely utilized in environments, such as, warehouses and factories, to provide a portable platform for handling, storing and moving materials. A typical pallet includes multiple spaced top slats mounted to a top surface of multiple spaced transverse support elements, which elevate the top slats from the ground and allow handling of the pallet with equipment, such as a forklift. Multiple bottom slats are also typically mounted to a bottom surface of the support elements to provide additional structural support for the pallet.

In general, weight, cost, structural strain, versatility of use, ease of transportation and ability to reuse the materials of the pallet are important factors in evaluating a pallet construction for an application. Historically, pallets have been constructed of wood. Recently, however, a number of plastic modular pallets have been suggested and/or introduced. The components for a plastic pallet may be injection molded, extruded or rotationally molded and may be made of various materials, such as polyethylene, polypropylene, polystyrene and polyvinyl chloride. U.S. Pat. No. 3,878,796 discloses a plastic pallet assembly that includes spaced longitudinal stringers with spaced boards attached to and extending transversely of the stringers. The stringers and boards include an arrangement of integral notches and shoulders and are interconnected by driving the components together. However, the plastic pallets disclosed in U.S. Pat. No. 3,878,796, are not constructed to prevent the boards from shifting in a direction transverse to the longitudinal stringers.

U.S. Pat. No. 5,101,737 discloses a pallet that includes spaced foundation rails having planar top and bottom walls with orthogonally oriented grooves arranged parallel to and extending co-extensively of each of the rails. A number of spaced bottom and top strips are provided that include leg pairs that are received by the grooves in the foundation rails such that a snap-fit inter-relationship is achieved between the foundation rails and the strips. The strips are connected to the foundation rails with gel packets that include epoxy resin and epoxy hardener, which mix during assembly and thereby permanently affix the strips to the foundation rails.

U.S. Pat. No. 5,440,998 discloses a plastic pallet that includes a number of spaced stringer members with integral fastening studs. Spaced longitudinal deck board members, which include apertures for receiving the fastening studs, are placed transversely to the stringer members at which point the studs are heated to affix the deck board members to the stringer members. In another embodiment, screws are utilized to attach the deck board members to the stringer members. It should be appreciated that removing a damaged deck board member from a transverse stringer member either requires heating of the studs or requires removal of screws depending upon the embodiment.

U.S. Pat. No. 5,458,069 discloses a plastic pallet that includes a number of spaced rails with integral posts and spaced cross members, which include apertures to receive the posts. The spaced rails are attached to the cross members by ultrasonically welding the posts to the cross members. In an alternative embodiment, the posts are threaded to receive a nut which, when in place, attaches the cross members to the rails.

U.S. Pat. No. 5,941,179 discloses a modular pallet that includes a number of spaced runners having transverse clasping slots and a number of spaced slats including longitudinal fastening ridges that are shaped to mate in releasable connection with the clasping slots in the runners. While the pallets described above are modular, the pallets described above do not generally provide a pallet that is readily assembled/disassembled and economically competitive.

What is needed is an improved modular pallet that is relatively low in cost, when compared to other commercially available modular pallets. It would also be desirable for the modular pallet to include components that readily interconnect in a reliable, efficient manner and which maintain the interconnection under normal use and are capable of being readily disassembled.

SUMMARY OF THE INVENTION

An embodiment of the present invention is directed to a modular pallet that includes a plurality of spaced substantially parallel elongated stringer members, a plurality of spaced substantially parallel elongated upper deck members and a plurality of spaced substantially parallel elongated lower deck members. The elongated stringer members each include a plurality of spaced upper grooves formed in a top surface and a plurality of spaced lower grooves formed in a bottom surface.

The upper deck members each include a first upper deck member mating section approximate a first end and a second upper deck member mating section approximate a second end. At least a portion of each of the upper deck members, between the first and second upper deck member mating sections, is shaped to be perpendicularly received by the upper grooves in the elongated stringer members and interlocked at the first and second upper deck member mating sections to different ones of the elongated stringer members by movement of at least one of the stringer member and the upper deck member with respect to each other.

The lower deck members include a first lower deck member mating section approximate a first end and a second lower deck member mating section approximate a second end. At least a portion of the lower deck member, between the first and second lower deck member mating sections, is shaped to be perpendicularly received by the lower grooves in the elongated stringer members and interlocked at the first and second lower deck member mating sections to different ones of the elongated stringer members by movement of at least one of the stringer member and the lower deck member with respect to each other.

In one embodiment, the upper and lower deck members are interchangeable and the upper and lower grooves are substantially identical. In another embodiment, the elongated stringer members include a plurality of bracing ribs formed at an angle between an upper flange and a lower flange. In yet another embodiment, the plurality of bracing ribs are formed on opposite sides of a center web that extends between the upper and lower flanges and runs along a center of the elongated stringer members. In still another embodiment, the elongated stringer member includes at least two spaced channels opening to the bottom surface and shaped to receive a lifting member of a lifting device. In still another embodiment, the upper and lower grooves are narrower at a groove opening than at a groove base. In another embodiment, the elongated stringer members each include a locking button extending from a groove base of each of the upper and lower grooves and the mating sections of the upper and lower deck members each include a locking socket for receiving the locking button.

These and other features, advantages and objects of the present invention will be further understood and appreciated by those skilled in the art by reference to the following specification, claims and appended drawings.

DETAILED DESCRIPTION OF THE PREFERRED EMBODIMENT(S)

The present invention is directed to a modular pallet whose components are designed to reduce the amount of plastic required for the pallet, while maintaining the structural integrity of the pallet. Similar to other modular pallets, the pallet can be shipped in an unassembled condition to reduce the storage area required by the pallet and be readily assembled when a pallet is required. The components of the pallet include novel mating sections, which reliably maintain the interconnection between components, while at the same time readily allowing for the disengagement of a component should the need arise, e.g., for the removal of a damaged component or break-down of the pallet for storage.

Figure 1:
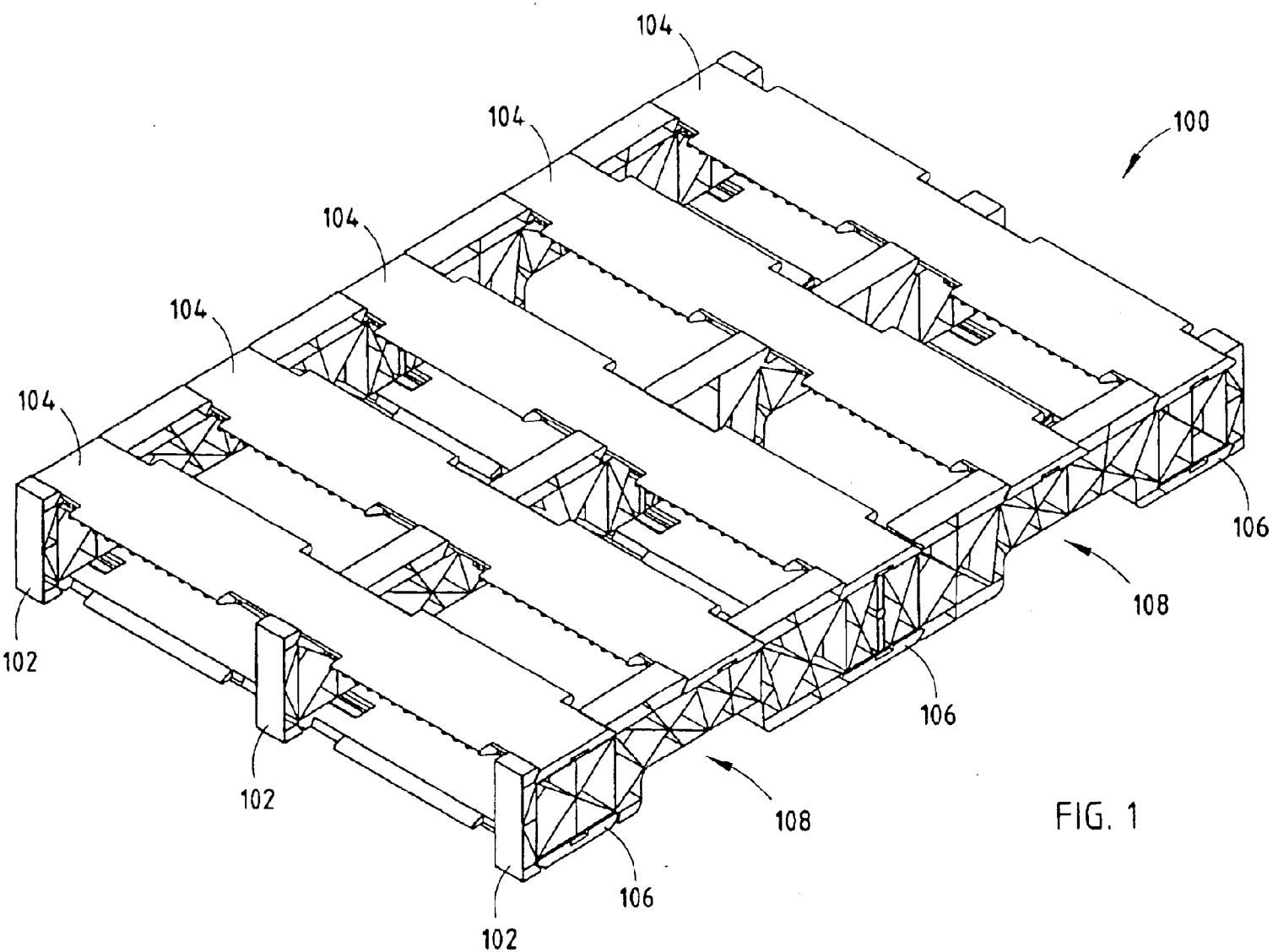
FIG. 1 is a perspective view of an assembled modular pallet, according to an embodiment of the present invention.

With reference to FIG. 1, an assembled modular pallet 100 includes three spaced substantially parallel elongated stringer members 102, with a pair of spaced channels 108 formed in a bottom surface of each of the elongated stringer members 102 and positioned to receive lifting members of a lifting device, e.g., forks or tines of a forklift. As is shown, the pallet 100 includes five spaced substantially parallel elongated upper deck members 104 and three spaced substantially parallel elongated lower deck members 106. The upper and lower deck members 104 and 106 and the elongated stringer members 102 may be formed of a variety of materials, e.g., polyethylene and polypropylene. It should be appreciated that any number of elongated stringer members and upper or lower deck members may be implemented depending upon the application. Further, it should be appreciated that the lower deck members may not be implemented in certain applications. In this case, the elongated stringer members may not include lower grooves to accept the lower deck members. Additionally, the upper and lower deck members may be offset with respect to each other.

Figure 2:
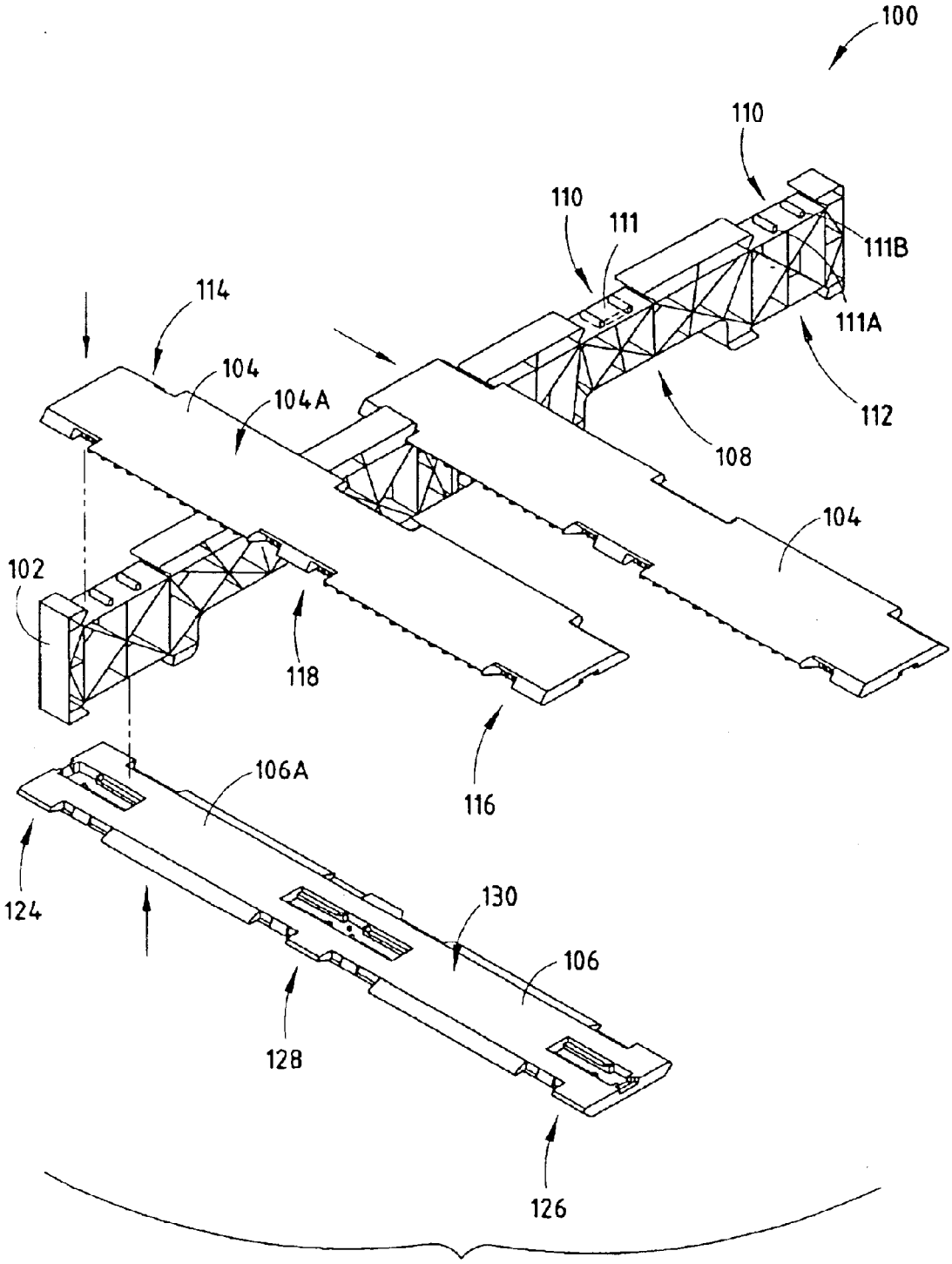
FIG. 2 is an exploded view of portions of the modular pallet of FIG. 1.

FIG. 2 depicts a partial exploded view of the pallet 100 of FIG. 1. As is shown in FIG. 2, the stringer members 102 include a plurality of spaced upper grooves 110 and a plurality of spaced lower grooves 112. Each of the upper and lower grooves 110 and 112 include a locking button 111, which may be solid or may take the form of two parallel locking ribs 111A and 111B or any number of other forms.

It should be appreciated that utilizing the two parallel locking ribs 111A and 111B reduces the amount of material used in the pallet 100. While the pallet 100 is shown utilizing three elongated stringer members 102, it should be appreciated that any number of elongated stringer members, dictated by the application, may be utilized. Further, while the pallet 100 of FIG. 1 includes five upper deck members and three lower deck members, it should be appreciated that any number of upper and lower deck members can be implemented according to the present invention.

With reference to FIG. 2, each of the upper deck members 104 include a first upper deck member mating section 114 adjacent a first end, a second upper deck member mating section 116 adjacent a second end and a middle upper deck member mating section 118 located between the first and second upper deck member mating sections 114 and 116. Each lower deck member 106 includes a first lower deck member mating section 124, a second lower deck member mating section 126 and a middle lower deck member mating section 128 located between the first and second lower deck member mating sections 124 and 126.

The first and second upper deck member mating sections 114 and 116 and the first and second lower deck member mating sections 124 and 126 are similarly constructed. Likewise, the middle upper deck member mating section 118 and the middle lower deck member mating section 128 are similarly constructed. It should be appreciated that in certain applications, it may be desirable to add additional middle upper/lower deck member mating sections or to entirely leave out such sections.

Figure 3:
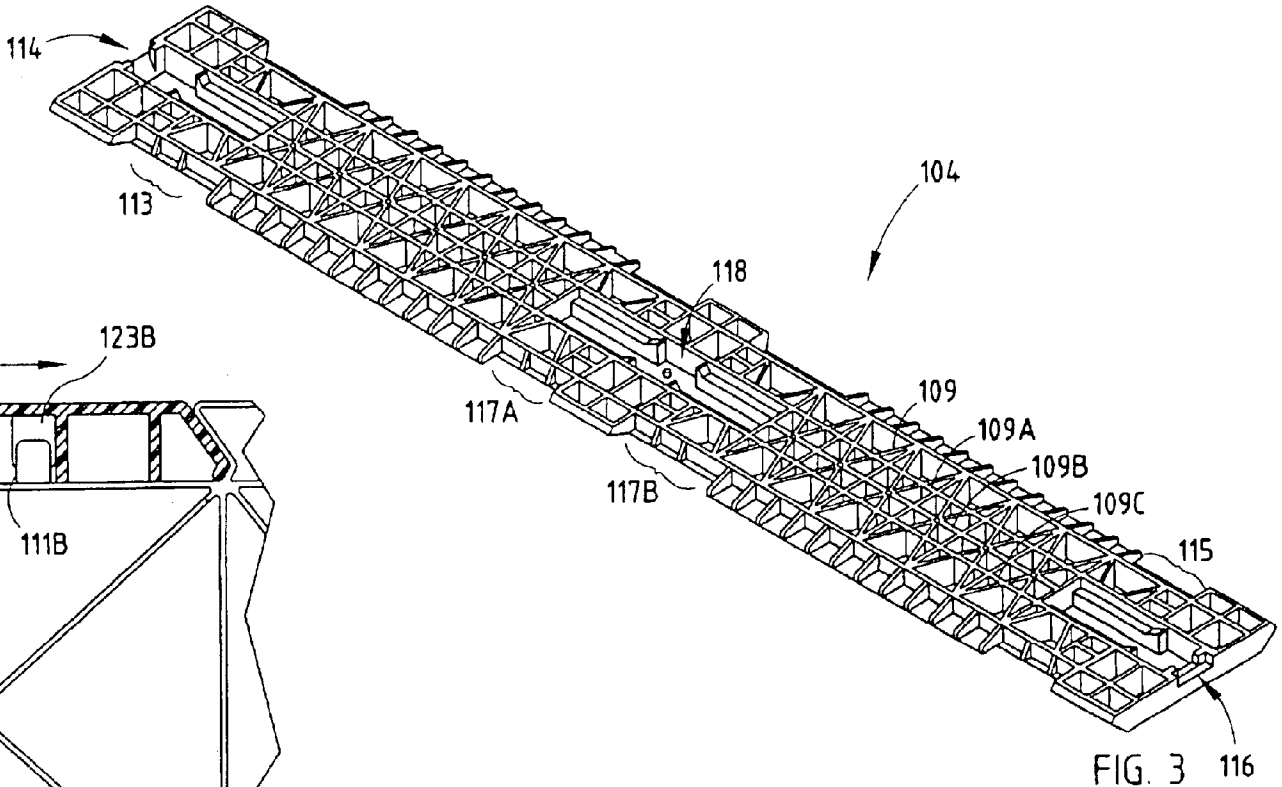
FIG. 3 is a bottom perspective view of an upper deck member for use in the modular pallet of FIG. 1.

FIG. 3 depicts a perspective view of a bottom of the upper deck member 104. As is illustrated in FIG. 3, the upper deck member 104 includes a plurality of intersecting support ribs 109 with a skin 104A formed on one side of the support ribs and acting as a top surface of the upper deck member (see FIG. 2). A portion 113 of the upper deck member 104, adjacent the first upper deck member mating section 114, is shaped and sized so as to be perpendicularly received by, i.e., dropped into, the upper grooves 110 in the elongated stringer members 102. Similarly, a portion 115 of the upper deck member 104, adjacent the second upper deck member mating section 116, is shaped to be perpendicularly received by the upper grooves 110 in the elongated stringer members 102. Likewise, when a middle upper deck member mating section 118 is implemented, portions 117A and 117B on opposite sides of the mating section 118 may be shaped to be perpendicularly received by the upper grooves 110 in the elongated stringer members 102. Alternatively, only one of portions 117A and 117B may be implemented.

It should be appreciated that by implementing support ribs 109 within the upper deck member 104, the weight and cost (as compared to a solid deck member) of an upper deck member can be substantially reduced with little resultant loss in the structural integrity of the deck member, providing that the support ribs 109 are formed at appropriate intervals and angles. It should also be appreciated that the entire upper deck member 104 may be shaped so as to be perpendicularly received by the upper grooves 110 in the elongated stringer members 102. As will be further described below, when an upper deck or a lower deck member 104/106 is installed into the grooves 110/112 of an elongated stringer member 102, the deck members 104/106 are dropped into the grooves 110/112 in the elongated stringer member 102 at which point the elongated stringer member 102 is moved away from the deck member 104/106 or the deck member 104/106 is moved transversely with respect to the elongated stringer member 102. While three elongated support braces 109A, 109B and 109C are shown extending along a length of the member 104, it should be appreciated that any number of support braces may be implemented, depending upon the application. For example, the center support rib 109B may be omitted or, alternatively, the center support rib 109B may be the only support rib implemented with the ribs 109C and 109A being omitted.

Figure 4:
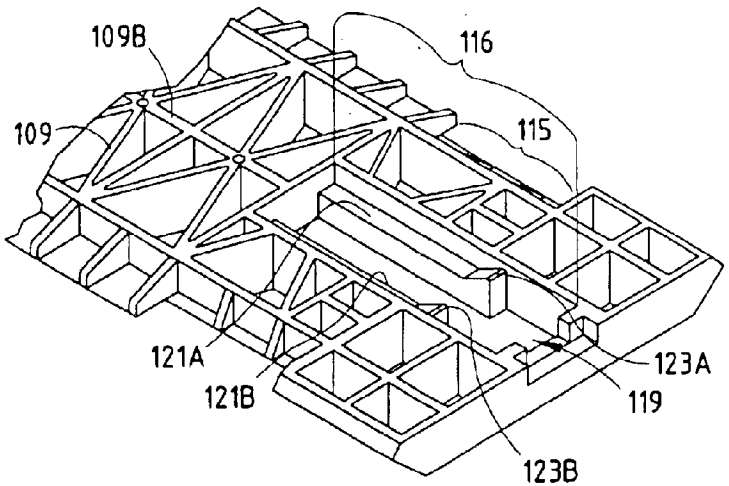
FIG. 4 is a partial bottom perspective view of a mating section of an alternate upper deck member for use in the modular pallet of FIG. 1.

FIG. 4 depicts an end of an upper deck member that only includes a center support rib 109B and, more specifically, depicts a view of the upper deck member mating section 116, which is located approximate a second end of the upper deck member 104. As is shown in FIG. 4, a pair of parallel rails 121A and 121B are located internal to the upper deck member 104 in the portion 115 of the upper deck member that is shaped so as to be received within one of the upper grooves 110 in the elongated stringer member 102. The parallel rails 121A and 121B transition into parallel ramps 123A and 123B, respectively, which engage the two parallel locking ribs 111A and 111B that extend from a groove base 110A of each of the upper grooves 110 of the elongated stringer members 102, when the member 104 is installed in one of the grooves 110.

As previously mentioned, other configurations for the locking button 111 may be implemented. For example, the locking button 111 may be a solid piece and the parallel rails 121A and 121B and the parallel ramps 123A and 123B may be formed as a solid piece. A suitable height for the parallel rails 121A and 121B is approximately 0.25 inches with respect to an inside surface of the skin 104A, which is formed on and in conjunction with the ribs 109. A suitable length for the parallel ramps 123A and 123B is approximately 0.5 inches with a height of approximately 0.375 inches. It should be appreciated that the dimensions of the parallel rails 121A and 121B and the parallel ramps 123A and 123B are dependent upon the overall cross-sectional thickness of the deck member 104, which is profiled and sized to be received in the groove 110 of the stringer member 102. As is also shown in FIG. 4, the second end of the upper deck member 104 includes a slot, which allows a disassembler to insert a tool such that the upper deck member 104 can be disengaged from the stringer member 102. The lower deck member 106 is constructed in a similar fashion as the upper deck member 104, with the exception of the location of skin 106A, and, as such, is not discussed further herein in detail.

Figure 5:
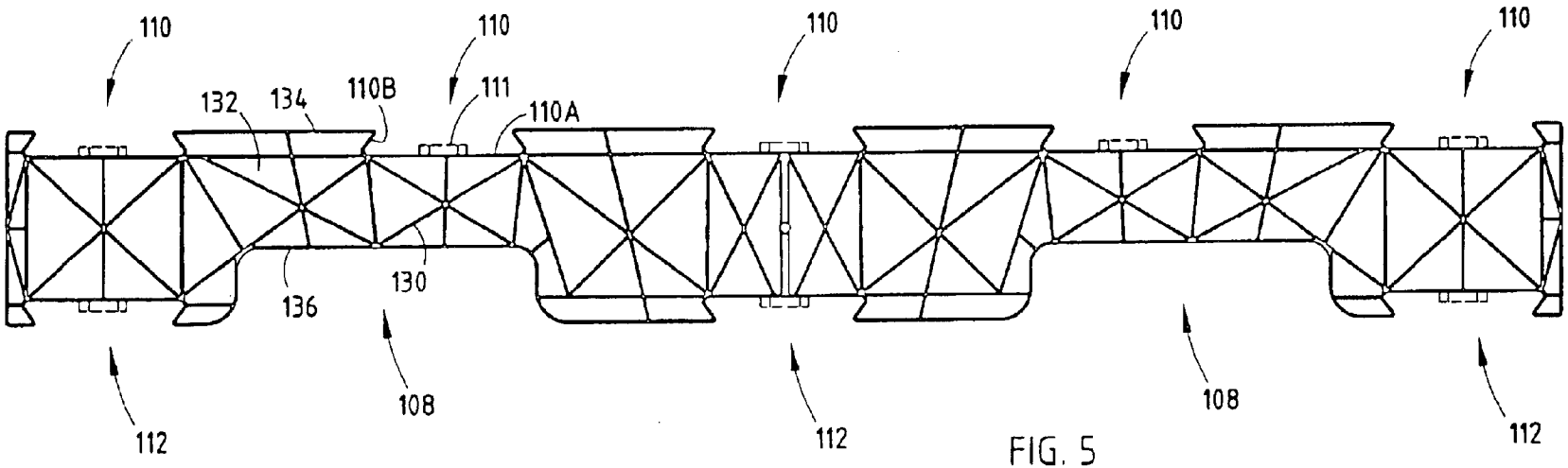
FIG. 5 is a side view of an elongated stringer member for use in the modular pallet of FIG. 1.

FIG. 5 depicts a side view of the elongated stringer member 102, according to one embodiment of the present invention. As is shown, the elongated stringer member 102 includes a plurality of bracing ribs 130, which are formed on opposite sides of a center web 132 that extends between upper and lower flanges 134 and 136 and runs along a center of the elongated stringer member 102. The upper deck member 104 and the lower deck member 106 are preferably constructed in a similar manner. The upper deck member 104 is closed at the top and open at the bottom and the lower deck member 106 is closed at the top and open at the bottom, with the exception that the lower deck member 106 is open in the area of the first, second and middle upper deck mating sections 124, 126 and 128. It will be appreciated that this allows the lower deck member 106 to be mated with the spaced lower grooves 112 formed in the bottom surface of the elongated stringer members 102. Closing off most of the top surface of the lower deck member 106 reduces the amount of trash that may accumulate within the interior of the lower deck member 106.

Figure 6:
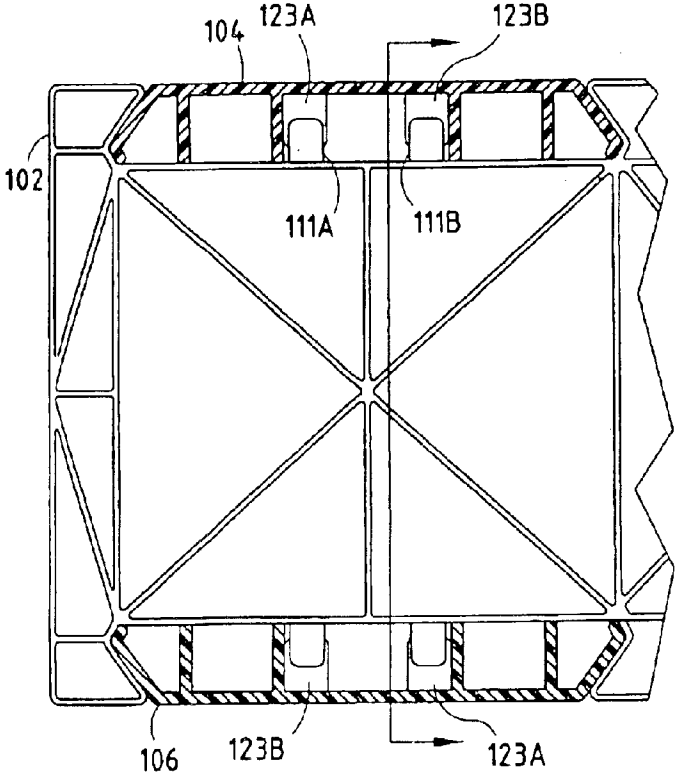
FIG. 6 is a partial side view of an elongated stringer member and an end of upper and lower deck members in cross-section, which further depicts the interconnection of the stringer member with the lower and upper deck members.

FIG. 6 depicts a portion of the pallet 100 with the ends of an upper deck member 104 and a lower deck member 106 in partial cross-section to show the relationship of the parallel locking ribs 111A and 111B with respect to the ends of the parallel ramps 123A and 123B, which form a portion of the locking socket 119. As is mentioned above, the lower deck member 106 is configured in a similar manner as that of the upper deck member 104 in the area of the first, second and middle lower deck member mating sections 124, 126 and 128 and, as such, is not further discussed herein.

Figure 9:
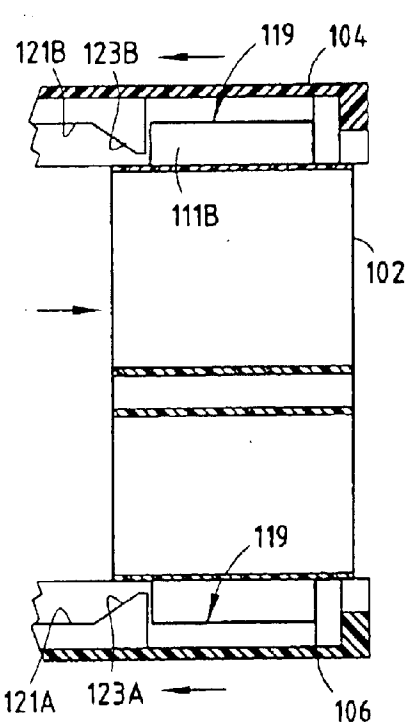
FIGS. 7–9 depict the mating of upper and lower deck members to an elongated stringer member.
Figure 8:
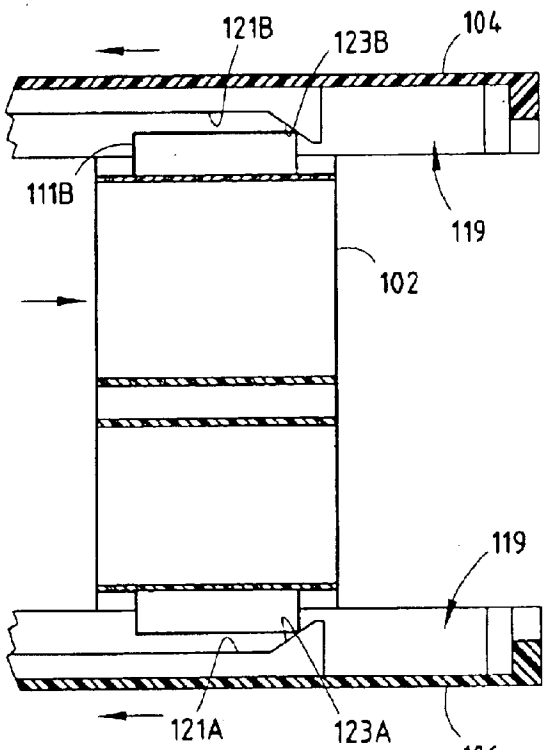
Figure 7:
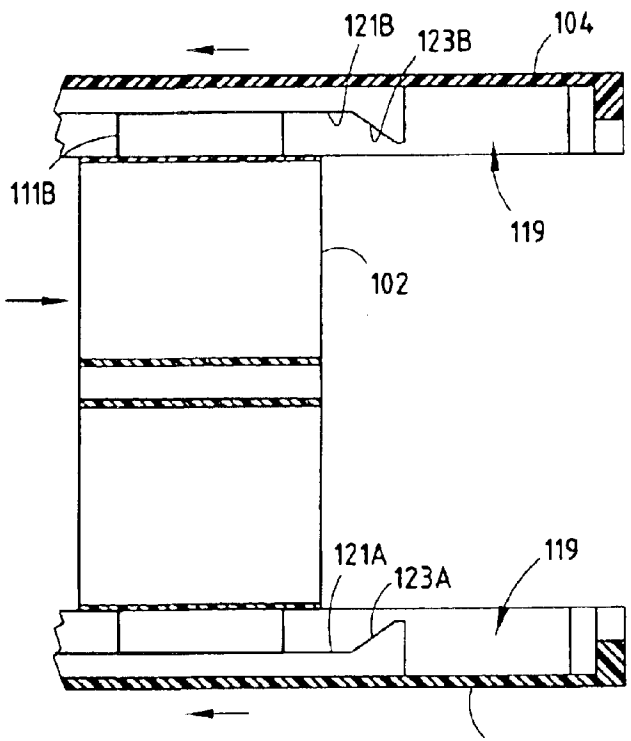

FIGS. 7, 8 and 9 further illustrate the interlocking of the upper and lower deck members 104 and 106 with one of the elongated stringer members 102. The upper deck member 104 is placed into the upper groove 110 in the stringer member 102 and the lower deck member 106 is placed into the groove 112 in the stringer member 102. With reference to FIG. 8, after insertion into the grooves 110 and 112 of the stringer member 102, the deck members 104 and 106 are moved transversely with respect to the stringer member 102 and at which point the ramp 123A of the upper deck member 104 engages the locking button 111, formed in the base of the groove 110. Upon further increase of the force applied to the member 104, the ramp 123A slides across locking button 111 capturing the locking button 111, as is shown in FIG. 9, into the locking socket 119 of the upper deck member 104. Similarly, the lower deck member 106 is installed in the lower groove 112 of the stringer member 102.

Accordingly, a modular pallet has been described herein whose components are designed to reduce the plastic required in the construction of the pallet, while at the same time producing a pallet that is structurally strong, as well as being readily assembled and disassembled as the need arises. As is previously discussed, the components of the pallet can be formed from various materials, depending upon the specific application. For example, when the pallet will be subject to colder temperatures, such as, being utilized in conjunction with a product that is refrigerated, a polyethylene material may be utilized. In a typical application where refrigeration is not utilized, materials such as polypropylene may be utilized. Advantageously, the modular pallet according to the present invention achieves interlocking between deck members and elongated stringer members while providing a secure connection and readily allowing for replacement of the components of the pallet if damaged or if the pallet is to be disassembled for storage.

The above description is considered that of the preferred embodiments only. Modification of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

What is claimed is:

1. A modular pallet, comprising:

a plurality of spaced substantially parallel elongated stringer members each including a plurality of spaced upper grooves formed in a top surface and a plurality of spaced lower grooves formed in a bottom surface;

a plurality of spaced substantially parallel elongated upper deck members each including a first upper deck member mating section approximate a first end and a second upper deck member mating section approximate a second end, wherein at least a portion of each of the upper deck members between the first and second upper deck member mating sections is shaped to be perpendicularly received by the upper grooves in the elongated stringer members and interlocked at the first and second upper deck member mating sections to different ones of the elongated stringer members by movement of at least one of the stringer member and the upper deck member with respect to each other; and a plurality of spaced substantially parallel elongated lower deck members including a first lower deck member mating section approximate a first end and a second lower deck member mating section approximate a second end, wherein at least a portion of the lower deck member between the first and second lower deck member mating sections is shaped to be perpendicularly received by the lower grooves in the elongated stringer members and interlocked at the first and second lower deck member mating sections to different ones of the elongated stringer members by movement of at least one of the stringer member and the lower deck member with respect to each other, and wherein the elongated stringer members each include a locking button extending from a groove base of each of the upper and lower grooves, and wherein the mating sections of the upper and lower deck members each include a locking socket for receiving the locking button.

2. The pallet of claim 1, wherein the upper and lower deck members are interchangeable, and wherein the upper and lower grooves are substantially identical.

3. The pallet of claim 1, wherein the elongated stringer members include a plurality of bracing ribs formed at an angle between an upper flange and a lower flange.

4. The pallet of claim 3, wherein the plurality of bracing ribs are formed on opposite sides of a center web that extends between the upper and lower flanges and runs along a center of the elongated stringer members.

5. The pallet of claim 1, wherein each of the elongated stringer members includes at least two spaced channels opening to the bottom surface and shaped to receive a lifting member of a lifting device.

6. The pallet of claim 1, wherein the upper and lower grooves are narrower at a groove opening than at a groove base.

7. The pallet of claim 1, wherein the locking button includes two parallel locking ribs.

8. The pallet of claim 1, wherein each of the upper deck members include a plurality of intersecting support ribs with a skin formed on one side of the support ribs and acting as a top surface of the upper deck member.

9. The pallet of claim 1, wherein each of the lower deck members include a plurality of intersecting support ribs with a skin formed on one side of the support ribs and acting as a top surface of the lower deck member.

10. The pallet of claim 1, wherein each of the upper deck members further include a middle upper deck member mating section between the first and second upper deck member mating sections, wherein at least a portion of the upper deck member between at least one of the first and middle lower deck member mating sections and the second and middle lower deck member mating sections is shaped to be perpendicularly received by the upper grooves in a centrally located one of the elongated stringer members and interlocked at the middle upper deck member mating section with the centrally located one of the elongated stringer members by movement of at least one of the centrally located one of the elongated stringer members and the upper deck member with respect to each other.

11. The pallet of claim 10, wherein each of the lower deck members further include a middle lower deck member mating section between the first and second upper deck member mating sections, wherein at least a portion of the lower deck member between at least one of the first and middle lower deck member mating sections and the second and middle lower deck member mating sections is shaped to be perpendicularly received by the lower grooves in the centrally located one of the elongated stringer members and interlocked with the centrally located one of the elongated stringer members by movement of at least one of the centrally located one of the elongated stringer members and the lower deck member with respect to each other.

12. The pallet of claim 1, wherein the upper and lower deck members and the stringer members are made of at least one polyethylene and polypropylene.

13. The pallet of claim 1, wherein the movement of one of the stringer member and the upper and lower deck members is transverse with respect to a line running along a length of the elongated stringer member.

14. A modular pallet, comprising:

a plurality of spaced substantially parallel elongated stringer members each including a plurality of spaced upper grooves formed in a top surface and a plurality of spaced lower grooves formed in a bottom surface;

a plurality of elongated upper deck members each including a first upper deck member mating section approximate a first end, a second upper deck member mating section approximate a second end, and a middle upper deck member mating section between the first and second upper deck member mating sections, wherein at least a portion of the upper deck members adjacent the first, middle and second upper deck member mating sections are shaped to be perpendicularly received by the upper grooves in the elongated stringer members and interlocked at the first, middle and second upper deck member mating sections to different ones of the elongated stringer members by movement of at least one of the stringer member and die upper deck member with respect to each other, and a plurality of elongated lower deck members including a first lower deck member mating section approximate a first end, a second lower deck member mating section approximate a second end, and a middle lower deck member mating section between the first and second lower deck member mating sections, wherein at least a portion of lower deck members adjacent the first, middle and second lower deck member mating sections of the lower deck members are shaped to be perpendicularly received by the lower grooves in the elongated stringer members and interlocked at the first, middle and second lower deck member mating sections to different ones of the elongated stringer members by movement of at least one of the stringer member and the lower deck member with respect to each other, and wherein the elongated stringer members each include a locking button extending from a groove base of each of the upper and lower grooves, and wherein the mating sections of the upper and lower deck members each include a locking socket for receiving the locking button.

15. The pallet of claim 14, wherein the upper and lower deck members are interchangeable, and wherein the upper and lower grooves are substantially identical.

16. The pallet of claim 14, wherein the elongated stringer members include a plurality of bracing ribs formed at an angle with respect to an upper flange and a lower flange.

17. The pallet of claim 16, wherein the plurality of bracing ribs are formed on opposite sides of a center web that extends between the upper and lower flanges and runs along a center of the elongated stringer members.

18. The pallet of claim 14, wherein each of the elongated stringer members includes at least two spaced channels opening to the bottom surface and shaped to receive a lifting member lifting device.

19. The pallet of claim 14, wherein the upper and lower grooves are narrower at a groove opening than at a groove base.

20. The pallet of claim 14, wherein the locking button includes two parallel locking ribs.

21. The pallet of claim 14, wherein each of the upper deck members include a plurality of intersecting support ribs with a skin formed on one side of the support ribs and acting as a top surface of the upper deck member.

22. The pallet of claim 14, wherein each of the lower deck members include a plurality of intersecting support ribs with a skin formed on one side of the support ribs and acting as a top surface of the lower deck member.

23. The pallet of claim 14, wherein the upper and lower deck members and the stringer members are made of at least one polyethylene and polypropylene.

24. The pallet of claim 14, wherein the movement of one of the stringer member and the upper and lower deck members is transverse with respect to a line running along a length of the elongated stinger member.

25. A modular pallet, comprising:

a plurality of spaced substantially parallel elongated stringer members each including a plurality of spaced upper grooves formed in a top surface and a plurality of spaced lower grooves formed in a bottom surface;

a plurality of elongated upper deck members each including a first upper deck member mating section approximate a first end, a second upper deck member mating section approximate a second end, and a middle upper deck member mating section between the first and second upper deck member mating sections, wherein at least a portion of the upper deck members adjacent the first, middle and second upper deck member mating sections are shaped to be perpendicularly received by the upper grooves in the elongated stringer members and interlocked at the first, middle and second upper deck member mating sections to different ones of the elongated stringer members by movement of at least one of the stringer member and the upper deck member with respect to each other; and a plurality of elongated lower deck members including a first lower deck member mating section approximate a first end, a second lower deck member mating section approximate a second end, and a middle lower deck member mating section between the first and second lower deck member mating sections, wherein at least a portion of lower deck members adjacent the first, middle and second lower deck member mating sections of the lower deck members are shaped to be perpendicularly received by the lower grooves in the elongated stringer members and interlocked at the first, middle and second lower deck member mating sections to different ones of the elongated stringer members by movement of at least one of the stringer member and the lower deck member with respect to each other, and wherein the movement of one of the stringer member and the upper and lower deck members is transverse with respect to a line running along a length of the elongated stringer member, and wherein the elongated stringer members each include a locking button extending from a groove base of each of the upper and lower grooves, and wherein the mating sections of the upper and lower deck members each include a locking socket for receiving the locking button.

26. The pallet of claim 25, wherein the upper and lower deck members are interchangeable, and wherein the upper and lower grooves are substantially identical.

27. The pallet of claim 25, wherein the elongated stringer members include a plurality of bracing ribs formed at an angle with respect to an upper flange and a lower flange.

28. The pallet of claim 27, wherein the plurality of bracing ribs are formed on opposite sides of a center web that extends between the upper and lower flanges and runs along a center of the elongated stringer members.

29. The pallet claim 25, wherein each of the elongated stringer members includes at least two spaced channels opening to the bottom surface and shaped to receive a lifting member of a lifting device.

30. The pallet of claim 25, wherein the upper and lower grooves are narrower at a groove opening than at a groove base.

31. The pallet of claim 25, wherein the locking button includes two parallel locking ribs.

32. The pallet of claim 25, wherein each of the upper deck members include a plurality of intersecting support ribs with a skin formed on one side of the support ribs and acting as a top surface of the upper deck member.

33. The pallet of claim 25, wherein each of the lower deck members include a plurality of intersecting support ribs with a skin formed on one side of the support ribs and acting as a top surface of the lower deck member.

34. The pallet of claim 25, wherein the upper and lower deck members and the stringer members are made of at least one polyethylene and polypropylene.

* * * * *

UNITED STATES PATENT AND TRADEMARK OFFICE

CERTIFICATE OF CORRECTION

PATENT NO. : 6,837,170 B2
DATED : January 4, 2005
INVENTOR(S) : Anthony Taft

It is certified that error appears in the above-identified patent and that said Letters Patent is hereby corrected as shown below:

Column 8,
Line 42, "die" should be -- the --;

Column 9,
Line 11, after "member" insert -- of a --; and

Column 10,
Line 33, after "pallet" insert -- of --.

Signed and Sealed this

Twelfth Day of July, 2005

JON W. DUDAS
*Director of the United States Patent and Trademark Office*